US010020561B2

(12) United States Patent
Kalistaja et al.

(10) Patent No.: US 10,020,561 B2
(45) Date of Patent: Jul. 10, 2018

(54) DEPOSITED THREE-DIMENSIONAL ANTENNA APPARATUS AND METHODS

(71) Applicant: Pulse Finland OY, Kempele (FI)

(72) Inventors: Esa Kalistaja, Oulu (FI); Riku Lambacka, Oulu (FI); Petteri Annamaa, Oulunsalo (FI)

(73) Assignee: PULSE FINLAND OY, Oulunsalo (FI)

( * ) Notice: Subject to any disclaimer, the term of this patent is extended or adjusted under 35 U.S.C. 154(b) by 692 days.

(21) Appl. No.: 14/491,684

(22) Filed: Sep. 19, 2014

(65) Prior Publication Data

US 2015/0138024 A1 May 21, 2015

Related U.S. Application Data

(63) Continuation-in-part of application No. 14/031,646, filed on Sep. 19, 2013.

(51) Int. Cl.
*H01Q 5/385* (2015.01)
*H01Q 1/24* (2006.01)
(Continued)

(52) U.S. Cl.
CPC ..... *H01Q 1/243* (2013.01); *H01Q 1/36* (2013.01); *H01Q 1/38* (2013.01); *H01Q 5/371* (2015.01);
(Continued)

(58) Field of Classification Search
CPC ..... H01Q 1/24; H01Q 1/243
See application file for complete search history.

(56) References Cited

U.S. PATENT DOCUMENTS 3,614,554 A 10/1971 Shield et al.
4,253,231 A 3/1981 Nouet
(Continued)

FOREIGN PATENT DOCUMENTS

CN 1262492 A 8/2000
CN 2567627 Y 8/2003
(Continued)

OTHER PUBLICATIONS

Ahn, et al., Omnidirectional Printing of Flexible, Stretchable, and Spanning Silver Microelectrodes, Mar. 20, 2009, vol. 323, www.sciencernag.com, 4 pages.
(Continued)

*Primary Examiner* — Graham Smith
*Assistant Examiner* — Noel Maldonado
(74) *Attorney, Agent, or Firm* — Gazdzinski & Associates, PC

(57) ABSTRACT

A "thin" and cost-effective three-dimensional antenna assembly and methods of use and manufacturing thereof. In one exemplary embodiment, the solution of the present disclosure is particularly adapted for small form-factor portable radio devices, and comprises an antenna (or array of antennas) deposited on a thin preformed flexible or deformable structure using a conductive fluid. The antenna (array) includes one or more antennas each having a radiator and a plurality of contacts. Use of the thin preformed structure allows, among other things, thinner form factors for the host wireless device, and obviates use of a separate molded carrier or other more costly or involved processes (such as laser direct structuring).

20 Claims, 9 Drawing Sheets

(51) Int. Cl.

| | |
|---|---|
| ***H01Q 1/36*** | (2006.01) |
| ***H01Q 1/38*** | (2006.01) |
| ***H01Q 9/42*** | (2006.01) |
| ***H01Q 5/371*** | (2015.01) |

(52) U.S. Cl.
CPC ..... *H01Q 5/385* (2015.01); *H01Q 9/42* (2013.01); *Y10T 29/49018* (2015.01)

(56) References Cited

U.S. PATENT DOCUMENTS

| | | | | |
|---|---|---|---|---|
| 4,547,961 | A | 10/1985 | Bokil et al. | |
| 4,847,986 | A | 7/1989 | Meinel | |
| 5,055,816 | A | 10/1991 | Altman et al. | |
| 5,126,714 | A | 6/1992 | Johnson | |
| 5,257,000 | A | 10/1993 | Billings et al. | |
| 5,487,214 | A | 1/1996 | Walters | |
| 5,781,091 | A | 7/1998 | Krone et al. | |
| 6,165,386 | A | 12/2000 | Endo et al. | |
| 6,184,833 | B1 | 2/2001 | Tran | |
| 6,285,327 | B1 * | 9/2001 | See | H01Q 1/243 343/702 |
| 6,421,013 | B1 | 7/2002 | Chung | |
| 6,440,750 | B1 | 8/2002 | Feygenson et al. | |
| 6,445,271 | B1 | 9/2002 | Johnson | |
| 6,533,866 | B1 | 3/2003 | Franz et al. | |
| 6,745,058 | B2 | 6/2004 | Boulay et al. | |
| 6,962,511 | B2 | 11/2005 | Gutierrez et al. | |
| 7,112,246 | B2 | 9/2006 | Schucker | |
| 7,241,181 | B2 | 7/2007 | Machado et al. | |
| 7,311,937 | B2 | 12/2007 | Hashimoto | |
| 7,345,645 | B2 | 3/2008 | Cho | |
| 7,477,194 | B2 | 1/2009 | Coleman et al. | |
| 7,480,979 | B2 | 1/2009 | Moren | |
| 7,642,918 | B2 | 1/2010 | Kippelen et al. | |
| 7,782,211 | B2 | 8/2010 | Yamaguchi et al. | |
| 7,859,481 | B2 | 12/2010 | Muraoka | |
| 8,115,684 | B2 | 2/2012 | Palin | |
| 8,148,818 | B2 | 4/2012 | Yamazaki et al. | |
| 8,237,248 | B2 | 8/2012 | Yamazaki et al. | |
| 8,284,117 | B2 | 10/2012 | Kim et al. | |
| 8,405,561 | B2 | 3/2013 | Handy et al. | |
| 8,659,487 | B2 | 2/2014 | Fan et al. | |
| 8,679,573 | B2 | 3/2014 | Van Sciver et al. | |
| 2001/0043135 | A1 | 11/2001 | Yamada et al. | |
| 2002/0118350 | A1 | 8/2002 | Cabiri et al. | |
| 2002/0121959 | A1 | 9/2002 | Fontana et al. | |
| 2003/0173678 | A1 | 9/2003 | Mizukoshi | |
| 2004/0144958 | A1 | 7/2004 | Conaghan et al. | |
| 2004/0203173 | A1 | 10/2004 | Peck et al. | |
| 2005/0266154 | A1 | 12/2005 | Devos et al. | |
| 2006/0159899 | A1 | 7/2006 | Edwards et al. | |
| 2006/0176139 | A1 | 8/2006 | Pleskach et al. | |
| 2006/0290457 | A1 | 12/2006 | Lee et al. | |
| 2007/0001796 | A1 | 1/2007 | Waffenschmidt et al. | |
| 2007/0102685 | A1 | 5/2007 | Kodas et al. | |
| 2007/0216510 | A1 | 9/2007 | Jeong et al. | |
| 2008/0204516 | A1 | 8/2008 | Kim et al. | |
| 2008/0314165 | A1 | 12/2008 | Rosenberg | |
| 2009/0124195 | A1 | 5/2009 | Kamijoh et al. | |
| 2009/0145640 | A1 | 6/2009 | Toyoda | |
| 2009/0146658 | A1 | 6/2009 | McDowell et al. | |
| 2009/0207198 | A1 | 8/2009 | Muraoka | |
| 2009/0226605 | A1 | 9/2009 | Chopra et al. | |
| 2009/0229108 | A1 | 9/2009 | Shamblin et al. | |
| 2010/0011568 | A1 | 1/2010 | Harding | |
| 2010/0052997 | A1 | 3/2010 | Kan et al. | |
| 2010/0127084 | A1 | 5/2010 | Pavate et al. | |
| 2010/0141533 | A1 * | 6/2010 | Gardner | H01Q 1/38 343/702 |
| 2011/0050381 | A1 | 3/2011 | Olson | |
| 2011/0096388 | A1 | 4/2011 | Agrawal et al. | |
| 2011/0140978 | A1 | 6/2011 | Maruyama | |
| 2011/0285492 | A1 | 11/2011 | Wang et al. | |
| 2011/0304520 | A1 * | 12/2011 | Djordjevic | H01Q 21/0087 343/893 |
| 2012/0038514 | A1 | 2/2012 | Bang | |
| 2012/0058676 | A1 | 3/2012 | Schaffer et al. | |
| 2012/0081420 | A1 | 4/2012 | Yu et al. | |
| 2012/0146855 | A1 | 6/2012 | Spencer et al. | |
| 2012/0235879 | A1 | 9/2012 | Eder et al. | |
| 2012/0319905 | A1 | 12/2012 | Fan et al. | |
| 2013/0076572 | A1 | 3/2013 | Lee et al. | |
| 2013/0076573 | A1 | 3/2013 | Rappoport et al. | |
| 2013/0076574 | A1 | 3/2013 | Rappoport et al. | |
| 2013/0176176 | A1 | 7/2013 | Vos et al. | |
| 2013/0229314 | A1 | 9/2013 | Kuehler et al. | |
| 2013/0234899 | A1 | 9/2013 | Pope et al. | |

FOREIGN PATENT DOCUMENTS

| | | | |
|---|---|---|---|
| CN | 1484935 | A | 3/2004 |
| CN | 1933968 | A | 3/2007 |
| CN | 101577361 | A | 11/2009 |
| CN | 101623915 | A | 1/2010 |
| CN | 101841983 | A | 9/2010 |
| CN | 202035225 | U | 11/2011 |
| CN | 102555652 | A | 7/2012 |
| CN | 103038942 | A | 4/2013 |
| CN | 202907365 | U | 4/2013 |
| CN | 203276723 | U | 11/2013 |
| CN | 103963544 | A | 8/2014 |
| EP | 2065837 | A1 | 6/2009 |
| EP | 2418924 | A1 | 2/2012 |
| EP | 2693564 | A1 | 2/2014 |
| JP | H0210705 | A | 1/1990 |
| JP | 2013065838 | A | 4/2013 |
| KR | 20040084747 | A | 10/2004 |
| KR | 20060133239 | A | 12/2006 |
| TW | 201043114 | A | 12/2010 |
| WO | WO-02054841 | A1 | 7/2002 |

OTHER PUBLICATIONS

Amin, et al., Performance-Optimized Quadrate Bowtie RFID Antennas for Cost-Effective and EGO-Friendly Industrial Applications, Progress in Electromagnetics Research, vol. 126, 49-64, 2012, 16 pages.

Barrio, et al., Screen-Printed Silver-Ink Antennas for Frequency-Reconfigurable Architectures in L TE Phones, Electronics Letters, Nov. 6, 2014, vol. 50, No. 23, pp. 1665-1667, 2 pages.

Filton, The Printed World, Briefing 3D Printing, The Economist, Feb. 12, 2011, 3 pages.

Koski, et al., Inkjet-printed passive UHF RFID tags: review and performance evaluation, Inti. Journal of Advanced Manufacturing Technology, reed Jun. 28, 2011, accepted Nov. 14, 2011, 18 pages.

Kuilla, et al., Recent Advances in Graphene Based Polymer Composites, Progress in Polymer Science 35 (2010) 1350-1375, 26 pages.

Maimaiti, Study of Inkjet printing as an Ultra-Low-Cost Antenna Prototyping Method and its Application to Conformal Wraparound Antennas for Sounding Rocket Sub-Payload, Utah State Univ., 2013, 85 pages.

Montanero J.M., et al., "Micrometer Glass Nozzles for Flow Focusing," Journal of Physics D, vol. 41, 2008, pp. 1-36.

Montanero J.M., et.al., Micrometer glass nozzles for flow focusing, Jun. 2010; Abstract and pp. 1-10.

Ortego, et al., Inkjet Printed Planar Coil Antenna Analysis for NFC Technology Applications, received Dec. 15, 2011, accepted Jan. 9, 2012, 7 pages.

Perelaer, et al., Inkjet Printing and Alternative Sintering of Narrow Conductive Tracks on Flexible Substrates for Plastic Electronic Applications, Feb. 2010, 23 pages.

Qu, et al., The Pad Printing Technology Evaluation in Mobile Phone Antenna Manufacture, Foxconn Inti Holding Group, 2010 IEEE, 4 pages.

Sowpati, et al., Performance of Printable Antennas with Different Conductor Thickness, Progress in Electromagnetics Research Letters, vol. 13, 59-65, 2010, 7 pages.

(56) References Cited

OTHER PUBLICATIONS

Walker, et al., Reactive Silver Inks for Patterning High-Conductivity Features at Mild Temperatures, Journal of the American Chemical Society (JACS), reed Oct. 1, 2011, 3 pages.

* cited by examiner

DEPOSITED THREE-DIMENSIONAL ANTENNA APPARATUS AND METHODS

PRIORITY AND RELATED APPLICATIONS

This application is a continuation-in-part of co-owned and co-pending U.S. patent application Ser. No. 14/031,646 filed Sep. 19, 2013 of the same title, which is incorporated herein by reference in its entirety.

This application is also related to co-owned and co-pending U.S. patent application Ser. No. 13/782,993 filed Mar. 1, 2013 and entitled "DEPOSITION ANTENNA APPARATUS AND METHODS", which claims priority to U.S. Provisional Patent Application Ser. Nos. 61/609,868 of the same title filed Mar. 12, 2012, and 61/750,207 of the same title filed Jan. 8, 2013, each of the foregoing which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to antenna apparatus for use in electronic devices such as wireless or portable radio devices, and more particularly in one exemplary aspect to a thin deposited three-dimensional (3D) antenna apparatus, and methods of utilizing the same.

DESCRIPTION OF RELATED TECHNOLOGY

Antennas are commonly found in most modern radio devices, such as mobile computers, mobile phones, Blackberry® devices, smartphones, tablet/phablet computers, personal digital assistants (PDAs), or other personal communication devices (PCD). Typically, these antennas comprise a planar radiating plane and a ground plane parallel thereto, which are connected to each other by a short-circuit conductor in order to achieve the desired matching for the antenna. The structure is configured so that it functions as a resonator at the desired operating frequency. Typically, these antennas are located on a printed circuit board (PCB) of the radio device, inside a plastic enclosure that permits propagation of radio frequency waves to and from the antenna(s). Other known antenna structures are included on flexible printed wiring boards (PWB).

Current trends in antenna design have increased the demand for thinner mobile communications devices. In order to save space, while still meeting required performance characteristics, recent antenna designs must follow the three-dimensional (3D) form of the mobile communications device outer cover or inner chassis. Prior art 3D antenna solutions require either: (1) creating an antenna pattern on a separate molded carrier; or (2) creating an antenna pattern directly onto the mobile communications device chassis or cover.

However, the molding processes for these known prior art approaches requires a minimum thickness for the molded plastic part that is defined by standard injection molded processes or other considerations, thereby making it difficult to create very thin structures. Furthermore, in implementations which utilize a separate molded carrier, an additional processing step must be utilized in order to mechanically affix the molded carrier to the underlying structure of the mobile communications device.

In addition, the logistic manufacturing chain for creating the antenna structure on the mobile communications device cover or chassis is often expensive as a result of, inter alia, high yield loss risk. This high yield loss risk is a result of the mobile communications device cover or chassis needing to go through the cover or chassis manufacturing process as well as the antenna manufacturing process. This is particularly problematic when multiple antennas need to be integrated onto the same chassis or cover.

The manufacturing of these prior art antenna structures is primarily realized by use of: (1) flexible printed circuit (FPC) technology; or (2) Laser Direct Structuring (LDS) technology. Each method has its respective strengths and weaknesses. For example, the FPC antenna, such as that disclosed in U.S. Pat. No. 6,778,139, the contents of which are incorporated herein by reference in its entirety, typically involves the use of a flexible insulating film that supports the underlying foil-based antenna design. The FPC antenna allows the antenna to be bent, but does not allow for full conformance with the underlying structure of the mobile communications device. For example, the FPC antenna cannot be readily bent over a double-curved surface and is limited in its ability to follow the topology of a surface, particularly around sharper bends. This limits the ability to place the FPC antenna on organic shapes, as well as on certain corner geometries.

The LDS antenna technology is perhaps the most flexible of the two aforementioned prior art manufacturing methodologies. Recent advances in LDS antenna manufacturing processes have enabled the construction of antennas directly onto an otherwise non-conductive surface (e.g., onto a thermoplastic material that is doped with a metal additive); the doped metal additive is subsequently activated by means of a laser. The activated areas of the LDS polymer are then subsequently plated. For example, an electrolytic copper bath followed by successive additive layers such as nickel or gold are then added to complete the construction of the antenna structure. However, the underlying antenna structure must be molded from expensive special resins which often do not contain good mechanical properties that are often required for the underlying device housing. In addition, there is also the risk of losing the entire molded cover or chassis should a defect arise in the antenna manufacturing process, thereby adding to the overall cost of the part.

Accordingly, there is a salient need for an antenna solution that can be utilized in, for example, portable radio device with a small form factor, and that offers a thinner 3D antenna structure at lower manufacturing costs and complexity than are currently available with prior art manufacturing techniques.

SUMMARY

The present disclosure satisfies the foregoing needs by providing, inter alia, a thin multi-dimensional antenna module, and methods of manufacturing thereof.

In a first aspect, an antenna assembly for use in mobile device is disclosed. In one embodiment, the assembly includes a thin flexible antenna structure comprising a radiator and a plurality of contacts. The radiator and contacts are deposited onto the thin flexible antenna structure using a flowable conductive fluid. The thin flexible antenna structure is bonded to a housing portion for the mobile device.

In another variant, the preformed flexible structure permits the antenna assembly to conform to one or more three-dimensional features present within the mobile device.

In a further variant, the conformance of the antenna assembly to the three-dimensional features comprises at least one angular bend in the flexible structure corresponding to at least one internal feature of the mobile device.

In yet another variant, the preformed flexible structure comprises a first side, second side, and an edge, and the radiator is formed over at least a portion of the edge such that the radiator extends from the first side to the second side.

In another variant, at least the radiator and the plurality of contacts have been cured using a curing process for the flowable conductive fluid. The curing process for the flowable conductive fluid is selected so as to, inter alia, mitigate damage to the flexible structure by the curing process.

In a further variant, the flexible structure comprises a plurality of apertures formed therethrough, the plurality of contacts are disposed on at least a first side of the flexible structure, the radiator is disposed at least one a second side of the flexible structure, and the radiator and the plurality of contacts are electrically connected with one another via at least conductive fluid disposed within the apertures.

In another aspect of the disclosure, a method of reducing risk of loss in a manufacturing process of a wireless device is disclosed. In one embodiment, the method includes: providing a low-cost substantially flexible substrate; and disposing a first antenna radiator on the substrate using a deposition process so as to form an antenna for use with at least one wireless interface of the wireless device.

In one variant, provision of the substrate and formation of the antenna reduce a cost associated with a failure of the antenna or wireless device to pass subsequent testing or inspection.

In another variant, the cost reduction comprises a cost reduction relative to deposition of the first antenna radiator on a housing component of the wireless device, the housing component having a significantly higher cost than a cost of the flexible substrate.

In a further variant, the wireless device comprises a thin form-factor wireless device that is not amenable to use of a molded antenna carrier.

In yet another variant, the method further includes: curing the first radiator using a curing process; disposing a second antenna radiator useful for a different wireless interface or frequency band from that of the first antenna radiator on the substantially flexible substrate; and curing the second radiator using a curing process. A probability of the antenna or wireless device with both first and second radiators failing to pass the subsequent testing or inspection is higher than that for the disposition of only the first antenna radiator due to additional process steps associated with the disposition of the second radiator and the curing thereof.

In a further aspect, a wireless mobile device is disclosed. In one embodiment, the device includes: a housing; at least one wireless transceiver, and an antenna assembly in signal communication with the at least one wireless transceiver. In one variant, the antenna assembly includes: a preformed thin flexible structure; and an antenna comprising a radiator and a plurality of contacts; the antenna radiator and the plurality of contacts are deposited on the plastic structure using a flowable conductive fluid.

In another variant, the thin flexible structure is bonded to the housing.

In a further variant, the thin form-factor of the mobile device is thinner than that achievable using a substantially inflexible molded antenna carrier assembly; and the deposition of the radiator on the flexible structure provides a lower cost of manufacturing than deposition of the radiator on the housing. The lower cost of manufacturing results at least in part from a cost differential between the flexible structure and at least a portion of the housing.

In yet another variant, use of the thin flexible structure and the deposition of the radiator thereon obviates a need for a more costly structure suitable for a laser direct structuring (LDS) process.

In another aspect, an antenna assembly is disclosed. In one embodiment, the assembly is adapted for use in a compact form factor mobile device, and includes: a first preformed thin flexible structure having a first antenna comprising a radiator and a first plurality of contacts disposed thereon; and a second preformed thin flexible structure having a second antenna comprising a radiator and a second plurality of contacts disposed thereon. In one variant, the first and second radiators and the first and second contacts are deposited on the first and second structures, respectively using a flowable conductive fluid; and the first and second structures are substantially stacked with respect to one another.

In another embodiment, the antenna assembly comprises a preformed thin three-dimensional (3D) plastic film structure, at least one deposited radiator pattern on the outer and/or inner surface and a plurality of deposited contacts on the inner surface. The assembly is advantageously thinner than prior art antenna, while also providing comparable or enhanced performance and reduced manufacturing cost in certain embodiments. In one embodiment, the outer and inner patterns are connected through via holes. In yet another embodiment, the outer and inner patterns are connected by depositing the pattern over the plastic film structure edge.

In another aspect, a method of manufacturing the aforementioned antenna assembly is disclosed. In one embodiment, the aforementioned thin 3D antenna assembly is formed by depositing a desired antenna structure using highly conductive fluid on an antenna form film manufactured using thermoforming or vacuum forming.

In another variant, the method includes: obtaining a thin flexible polymer structure; disposing a first antenna radiator on the thin flexible polymer structure using a deposition process so as to form an antenna for use with at least one wireless interface of the mobile device; and bonding the antenna with a housing portion associated with the mobile device.

Further features of the present disclosure, its nature and various advantages will be more apparent from the accompanying drawings and the following detailed description.

BRIEF DESCRIPTION OF THE DRAWINGS

The features, objectives, and advantages of the present disclosure will become more apparent from the detailed description set forth below when taken in conjunction with the drawings, wherein.

Figure 1:
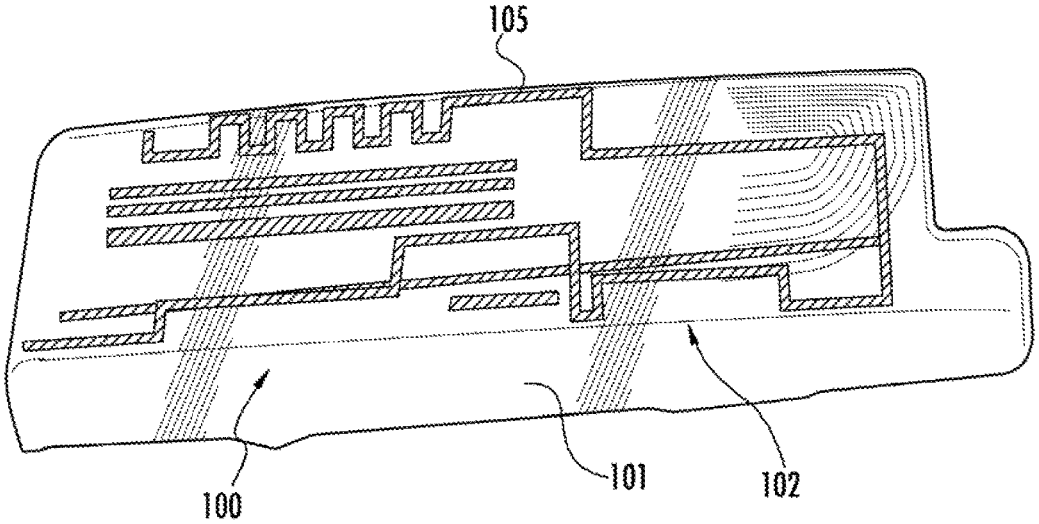
FIG. 1 is a perspective view detailing a first embodiment of an antenna module, deposited on an exemplary preformed thin plastic film, in accordance with the principles of the present disclosure.

All Figures disclosed herein are © Copyright 2013-2014 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna," "antenna system," "antenna assembly", and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet or "phablet" computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "RF feed," "feed," "feed conductor," and "feed network" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DC'S, Long Term Evolution (LTE) or LTE-Advanced (LTE-A), analog cellular, CDPD, Near Field Communication (NFC), Radio Frequency ID (RFID), satellite systems such as GPS, millimeter wave or microwave systems, optical, acoustic, and infrared (i.e., IrDA).

Overview

The present disclosure provides, inter alia, an improved low-cost, "thin" antenna, and methods for manufacturing and utilizing the same. Embodiments of the improved antenna described herein are adapted to overcome the disabilities of the prior art by, inter alia, providing a thinner three-dimensional (3D) antenna structure at a lower manufacturing cost. Specifically, embodiments of the present disclosure leverage the deposition of antenna structure (radiator and contacts) via highly conductive fluid on a preformed thin plastic film to reduce both the thickness of the antenna assembly (approximately 0.30 mm), and decreasing the manufacturing cost. In one variant, cost is reduced by both: (i) eliminating the loss of a complete device housing or cover component in the case of defects; and (ii) eliminating the need to manufacture the device cover from expensive special resin or other materials (such as would be suitable for prior art laser direct structuring or LDS processing).

Advantageously, the exemplary thin 3D antenna assembly disclosed herein also provides for easy integration with the device structure. The radiator may be deposited on either an outer surface or inner surface of the preformed plastic film structure (or both), and may even traverse the edge(s) of the film. The thin antenna assembly is also highly flexible or deformable, such that various 3D shapes can readily be achieved (e.g., to accommodate various internal features of the host device).

Exemplary embodiments of the antenna assembly are also adapted for ready use by automated manufacturing devices, thereby increasing manufacturing efficiency.

DETAILED DESCRIPTION OF EXEMPLARY EMBODIMENTS

Detailed descriptions of the various embodiments and variants of the apparatus and methods of the disclosure are now provided. While primarily discussed in the context of mobile communication devices, the various apparatus and methodologies discussed herein are not so limited. In fact, the apparatus and methodologies described herein are useful in any number of devices, whether associated with mobile or fixed devices that can benefit from the deposited 3D antenna methodologies and apparatus described herein.

It should further be noted that a wide range of preformed structure configurations may be used in conjunction with the features disclosed herein. For example, while primarily discussed in the context of 2D and 3D printing techniques using conductive fluids, it is appreciated that the exemplary apparatus, process flows and methodologies described herein are not so limited. For example, the use of so-called pad printing techniques as well as techniques such as is currently be used in so-called flexible circuit technology could be readily adapted for use in the antenna methodologies and apparatus described herein.

Exemplary Antenna Apparatus

Figure 1A:
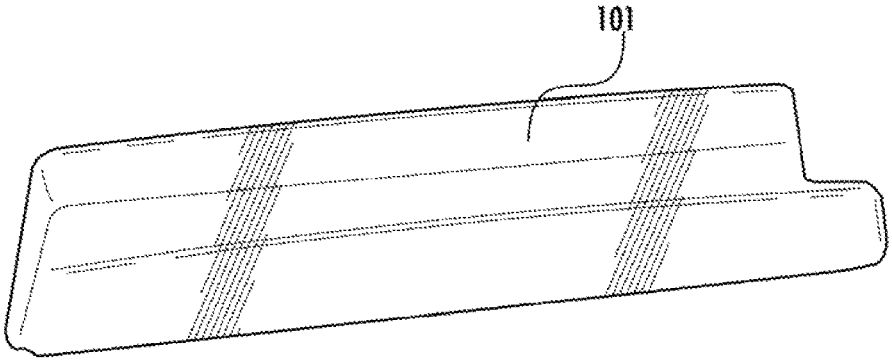
FIG. 1A is a perspective view detailing the preformed thin 3D plastic film structure utilized in the embodiment of FIG. 1.
Figure 1B:
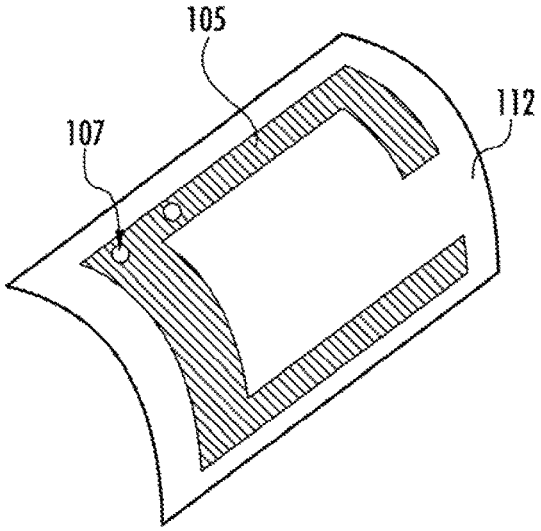
FIG. 1B is a perspective view of the topside of an antenna assembly, such as that shown in FIG. 1, illustrating the deposited radiator pattern on an outer surface of the exemplary preformed thin 3D plastic film structure.
Figure 1C:
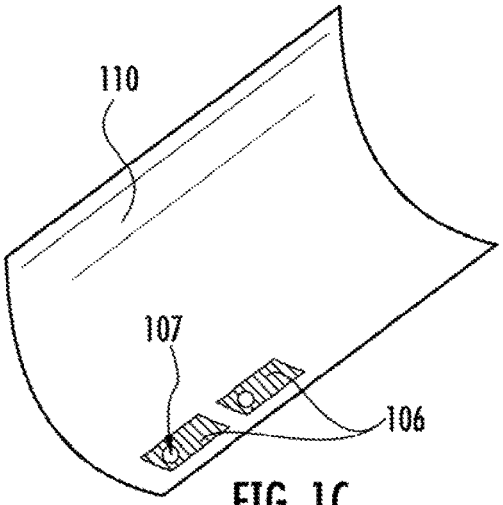
FIG. 1C is a perspective view of the underside of the antenna assembly of FIG. 1B, illustrating the deposited contacts pattern on the inner surface of the exemplary preformed thin 3D plastic film structure.

Referring now to FIGS. 1 through 1C, exemplary embodiments of the radio antenna apparatus of the disclosure are described in detail.

It will be appreciated that while these exemplary embodiments of the antenna apparatus of the disclosure are implemented using a 3D antenna configuration, the disclosure is in no way limited to the 3D antenna configurations, and in fact can be implemented as a planar (substantially two dimensional or 2D) antenna or array, or a plurality of 2D antennas that form a 3D array.

One exemplary embodiment 100 of an antenna apparatus for use in a mobile radio device is presented in FIG. 1, showing a preformed plastic film structure 101 and 3D deposited antenna structure 102. The preformed plastic structure 101 may be formed of any desirable materials, such as a film of plastic material, e.g. of one plastic material, or a blend of plastic materials such as PEEK (polyether ether ketone), PET (polyethylene terephthalate), PEN (polyethylene naphthalate), PC (polycarbonate), ABS (acrylnitrile butadiene styrene), and PI (polyimide). The material used to form the plastic film structure 101 can, if desired, be selected so that the plastic film structure retains its shape once it is formed into a 3D configuration (i.e., after being bent or flexed). Alternatively, the structure 101 can be made flexible yet resilient; i.e., such that it tends to return to its original shape. Combinations of the foregoing may be used as well, such as where: (i) the material is resilient until a yield point is reached, whereafter the resiliency is substantially reduced or eliminated, or (ii) different portions of the film have different material properties (e.g., a "hybrid" configuration is utilized). Other design considerations such as antenna design/pattern, the deposition process used, and cost may be considered as well in the selection of material and/or physical properties of the film. The film may have already a coating applied on one side which gives protection against abrasion or wear, or which provides other desired mechanical or electrical properties. The film may be transparent or non-transparent/colored; e.g., the film may have a color itself, or at least a colored layer may be deposited on the film.

As shown in FIGS. 1 and 1A, while the plastic film structure 101 of the current embodiment is preformed to take the shape of the external portable device, it can be appreciated that the plastic film structure 101 can be performed to take any desirable geometric shape. Moreover, the present disclosure contemplates deformation of the assembly including the film after the deposition of the antenna conductive trace(s) (described below).

The exemplary embodiment of the plastic film structure 101 comprises a first (e.g., inner) surface 110 and a second (e.g., outer) surface 112. Furthermore, spatial features of the inner and outer surface 110 and 112 can be related, or can be independent of each other. For example, a relatively substantial depression in one of the inner or outer surface could necessarily be present in the other of the inner and outer surface. On the other hand, the outer surface 112 might have a relatively smooth surface with only curves over its entire area, while the inner surface 110 might have a different surface or texture, or include corners and notches and bosses and the like so as to provide additional space, or to provide retaining features for components that will be positioned adjacent the inner surface 110.

The plastic film structure is designed to be integrated into a mobile device using conventional processes such as mechanical fitting, gluing, and over-molding, after the antenna deposition (and curing). Thus, in the current embodiment, the plastic film structure 101 has a 3D shape prior to integration into the host device, and once integrated into the mobile device, may be present in a laminate-like configuration. The thickness of the film is between 0.1 mm to 0.3 mm in exemplary implementations, although it will be appreciated that values greater or less than the aforesaid thickness may be used consistent with the disclosure. Additionally, it will be appreciated that the film may vary in thickness or other properties as a function of position, such as where one region is thicker or thinner, more or less dense, more or less transparent, more or less electrically non-conductive, etc. than another.

Deposited on the plastic film structure 101, using a highly conductive fluid, is an antenna array 102 that, as depicted in FIG. 1A, includes one or more antennas 102, each of which have a body 105 (radiator pattern) and contacts 106*a*, 106*b*. As can be appreciated, certain antenna designs may include a single-feed design (and thus require a single contact 106), while other antenna designs may include a multiple-feed design and include contacts. As can be further appreciated, the shape of the body 105 (radiator pattern) for each antenna in the antenna array 102 will depend on the intended use of the antenna. While the antenna array 102 may include a single antenna, it may also include some larger number of antennas. For instance, the array may include a first antenna for a first wireless interface technology/frequency band, and a second antenna for a second interface/band.

In the exemplary embodiment, deposition of the conductive fluid for the radiator is accomplished using the techniques described in co-owned and co-pending U.S. patent application Ser. No. 13/782,993 filed Mar. 1, 2013 and entitled "DEPOSITION ANTENNA APPARATUS AND METHODS", previously incorporated herein, although it will be appreciated that other approaches may be used in place of or in conjunction with the foregoing.

As shown in the embodiment of FIGS. 1B and 1C, the radiator pattern of the antenna array 105 may be deposited on the outer surface 112 and/or inner surface 110, while the contacts 106 may be deposited on the inner surface 110. Outer and inner surface patterns may be connected either through via holes 107 (contacts 106) or by depositing the pattern over the plastic film structure edge; i.e., at a curve and/or corner. "Via" holes are holes in the preformed plastic film structure 101 which are deposited over using the highly conductive fluid to form contacts, thereby creating a conductive through-hole structure. As can be appreciated, some contacts may be configured for one contact method, while other contacts are suitable for another contact method. The resulting 3D shape of the antenna array 102 allows it to fit on the plastic structure 101 while taking maximum advantage of the space allowed, yet with minimum thickness.

Figure 2:
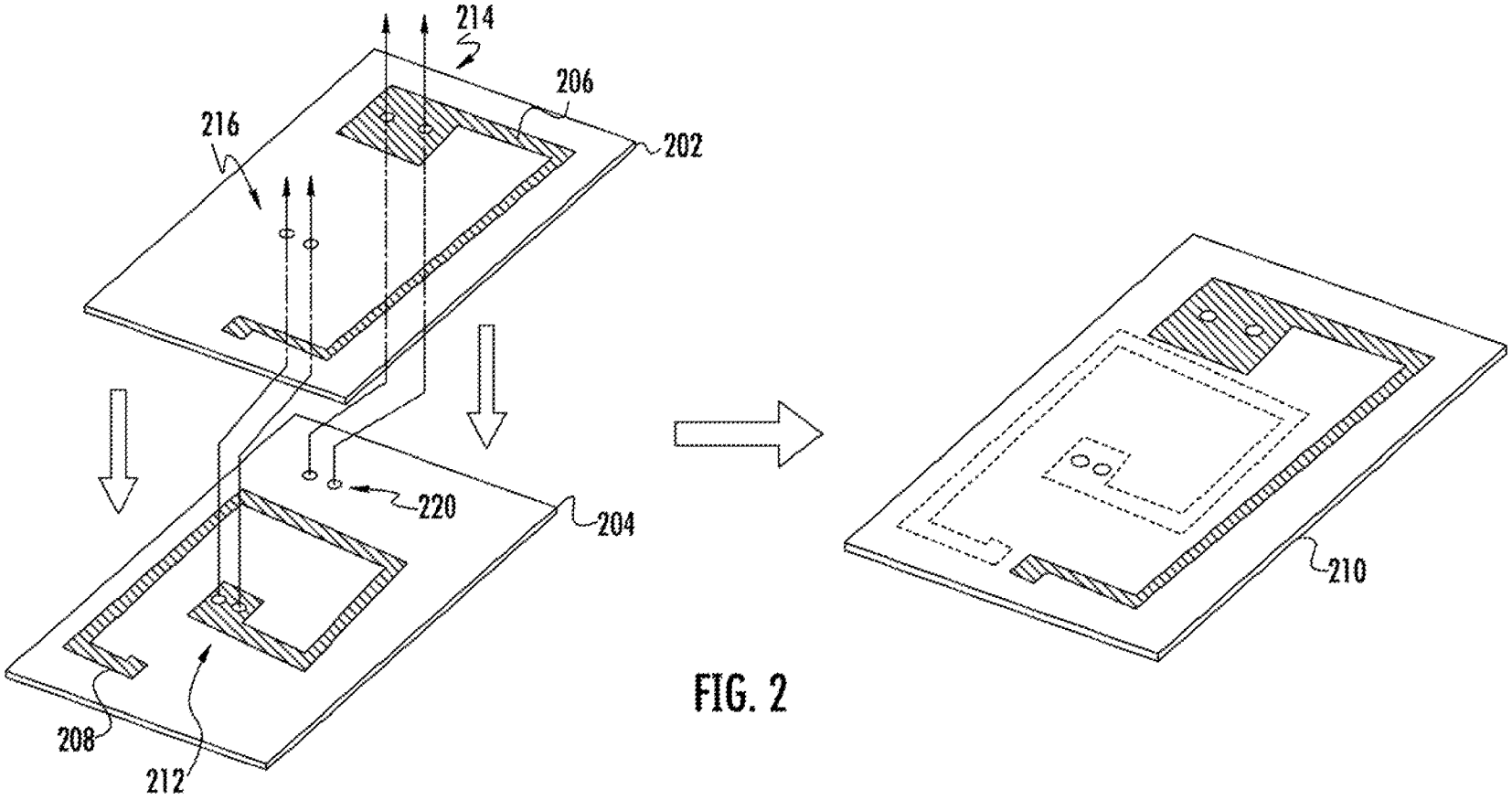
FIG. 2 is a perspective exploded view of one embodiment of a multi-layer antenna assembly according to the invention.

It will also be appreciated that a multi-layer approach may be used consistent with the disclosure. Specifically, in one such variant (FIG. 2), the antenna assembly 200 includes a first film-like structure 202 and a second film-like structure 204. The two structures 202, 204 include respective antenna traces (radiators) 206, 208 disposed on the film-like structures using e.g., a conductive fluid deposition process of the type previously referenced herein. The two structures are then cured (as separate structures), and then mated together to form a multi-layer structure 210 as shown in FIG. 2, which also may optionally include one or more interposed layers (not shown), such as for electrical insulation, mechanical rigidity, or to achieve other desired properties. The various layers may be bonded together using mechanical techniques (e.g., clips, heat staking, etc.), via adhesive, via thermal bonding (in effect "melting" them together), or any other approach suitable for the intended application.

As shown in FIG. 2, the vias or through-holes 212, 214 of each structure can also be aligned with complementary holes 216, 218 formed in the other structure if desired, such as to permit electrical connection ingress/egress from the opposing side.

In the illustrated exemplary embodiment, the structures overlap each other completely, although it will be appreciated that such overlap is by no means a requirement of the disclosure. For instance, partial overlap may be used.

Moreover, while the embodiment of FIG. 2 is shown with the structures 202, 204 in a non-deformed or planar state, one or more of the structures can be deformed before mating (such deformation which may be either before or after the application of the radiator(s) via fluid deposition).

Methods of Manufacture

Figure 3A:
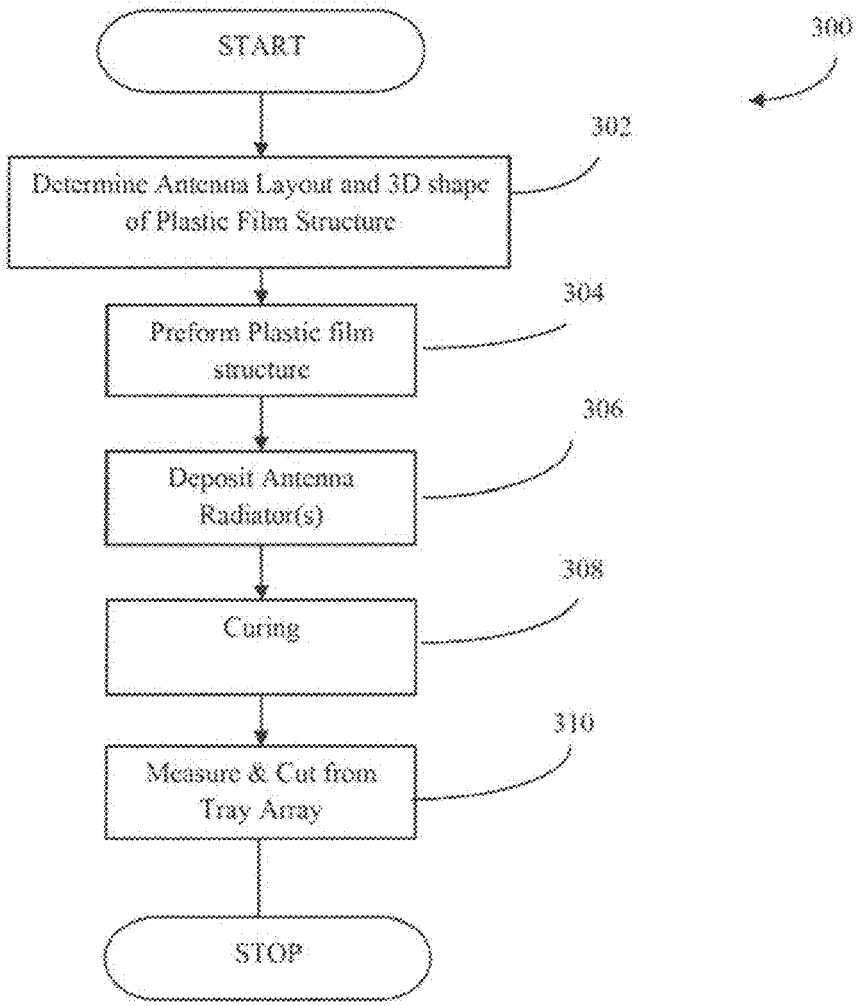
FIG. 3A is a logical flow chart illustrating a first exemplary embodiment of a method of manufacture of the antenna assembly of FIG. 1.

Referring now to FIG. 3A, a first exemplary embodiment of a method 300 for manufacturing the aforementioned antenna assembly is shown and described in detail.

At step 302, an antenna layout is determined. This typically involves taking the intended 3D shape of the plastic film structure 101, and determining how the antenna array 102 should be positioned on the plastic film structure 101. Aspects that can be addressed in this process include determining how electrical contact to contacts are going to be provided as well as the intended operating frequencies of the antenna array, the desired shape and size of the antenna array, and any other restrictions imposed by the host device. Modeling software can be used to determine a layout that provides acceptable antenna performance, although other techniques (including hand layout and trial-and-error) can be used with success consistent with the disclosure.

Once the desired 3D shape is determined, a thin plastic film is preformed into the desired shape or structure using conventional thermoforming and/or vacuum forming processes at step 304. In thermoforming, the thin plastic film is heated to a pliable forming temperature, formed to the specific shape in a mold or on a shaped object (e.g., anvil), and trimmed. Vacuum forming involves heating the plastic film to a forming temperature, stretching onto or into a single-surface mold, and holding against the mold by applying a vacuum between the mold surface and the plastic film. "Jig" milling of a plastic film to form the desired structure may also be utilized. However, it can be appreciated that other suitable processes and materials may be easily substituted. The aforementioned process allows for the formation of 90 degree walls and corners with small radiuses.

It will also be appreciated that several of the plastic film structures can be processed in parallel, such as where a larger sheet of the film material is processed simultaneously (or sequentially) using a common process (such as in an array or tray). The plastic film structure 101 may be cut from the tray array to obtain individual structures or left in an array form for the next deposition step.

Next in step 306, the desired antenna array structure (radiator pattern and contacts) is deposited onto the film using a conductive fluid. For instance, in the exemplary embodiment, the methods and apparatus of U.S. patent application Ser. No. 13/782,993 filed Mar. 1, 2013 and entitled "DEPOSITION ANTENNA APPARATUS AND METHODS" are used for the deposition process, although others may be used with equal success. In the exemplary embodiment, the radiator pattern and contacts are made from the same fluid; however, it will be appreciated that the contacts can be made also from another (different) fluid, or coated or retreated with another fluid, depending on the application and desired attributes. The deposited contacts are generally configured to facilitate electrical communication with a transmitter/receiver. Conventional methods for contacting the antenna contacts can include solder, brazing, or mechanical devices such as pogo pins and/or clips, although it will also be appreciated that the deposition process can be used to form the contact with e.g., a feed conductor directly, as described in the foregoing incorporated patent application Ser. No. 13/782,993. Additionally, to improve electrical contact between the antenna contact area and the corresponding connecting conductor (e.g., feed or the like), a surface layer or other bonding agent may be provided over the antenna contact area.

The deposited antenna structure is cured at step 308 using thermal, infrared or microwave based methods, such as those described in detail in U.S. patent application Ser. No. 13/782,993, previously incorporated. The desired method may be selected depending on the conductive fluid used in deposition, as well as the material for the flexible film/substrate (i.e., one compatible with the material).

At step 310, the antenna assembly is measured and cut from the tray array (if a tray was used, and cutting was not performed after step 304).

Figure 3B:
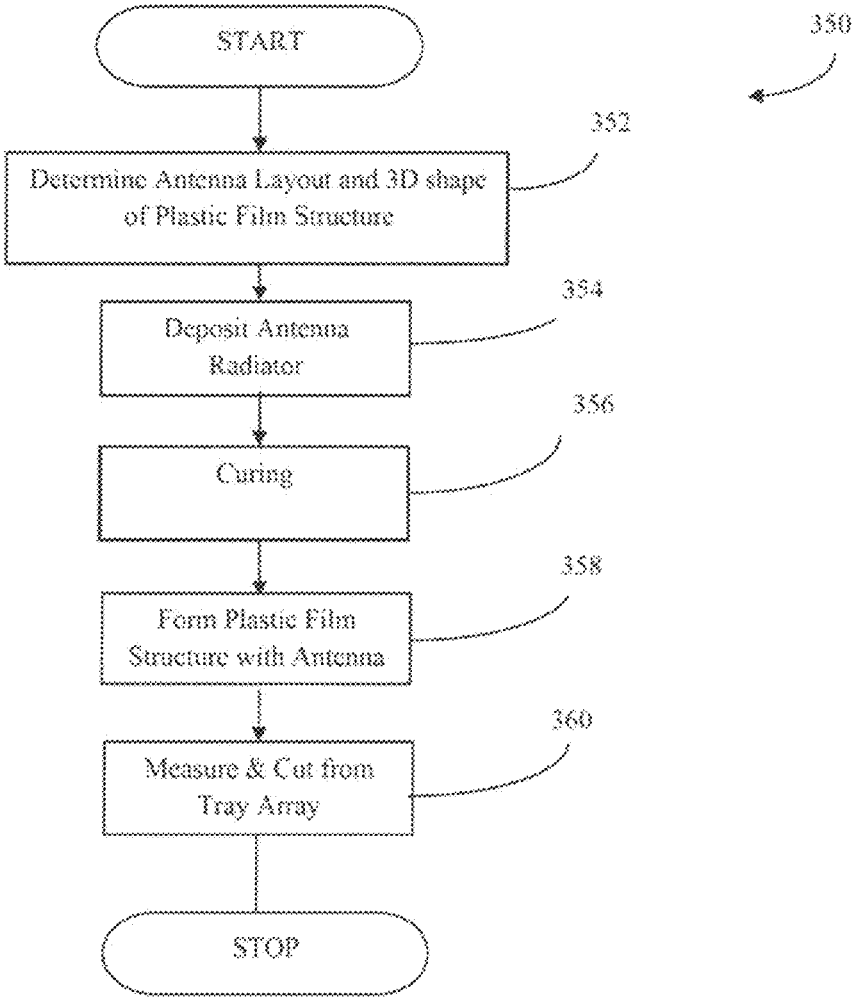
FIG. 3B is a logical flow chart illustrating a second exemplary embodiment of a method of manufacture of the antenna assembly of FIG. 1.

FIG. 3B illustrates another embodiment of the method of manufacturing, wherein the deformation of the film-like structure occurs after deposition of the radiator trace and contacts. As shown, the layout is first determined (step 352), after which the antenna radiator trace(s) and contacts are deposited onto the film (step 354). The deposited conductive fluid is then cured (step 356), and then the film (with antenna and contacts) is deformed per step 358. It will be appreciated that as mechanical stress is applied to the film, certain of the traces/contact areas may undergo tensile or compressive stress; however, so long as the radius of the bend is not too small, the conductivity and performance of the antenna may experience little or no degradation resulting therefrom.

Figure 4:
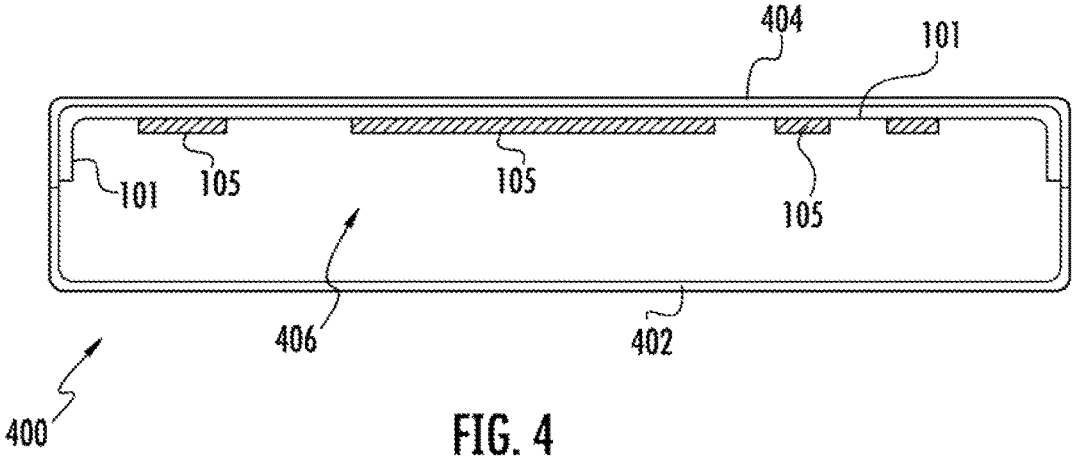
FIG. 4 is a cross-sectional view of an exemplary thin form factor wireless device with an exemplary embodiment of the antenna assembly of the present disclosure disposed therein.

FIG. 4 illustrates an exemplary mobile wireless device 400 (e.g., smartphone or tablet/phablet) having the thin form-factor antenna assembly of the present disclosure disposed therein. Various internal components (i.e., display, wireless interfaces, processor, boards, battery, memory, etc.) are deleted from the interior of the device 400 for purposes of clarity. As shown in FIG. 4, the device 400 includes a housing (here, upper and lower housing portions 404, 402, although any number of different configurations may be used consistent with the present disclosure), that forms an interior cavity or space 406. The flexible substrate 101 is disposed in this example adjacent and substantially conforming to the interior of the upper housing 404, although this is but one possible placement of the substrate 101 within the cavity; for instance, the substrate 101 could be disposed with a stand-off distance from the upper housing 404, overlapping the upper and lower housings 404, 402, on the ends of the housing, and so forth.

The antenna radiator element(s) 105 is/are in this example disposed on the interior surface of the substrate 101 as shown, although it can be disposed on the outer surface, or combinations thereof, if desired. It will be appreciated that the exemplary placement of the radiator(s) 105 allows, inter alia, replacement or rework of the radiator pattern in the event of a defect, obviates the need to use expensive housing plastics (e.g., for LDS), along with other benefits previously described herein.

Figure 5A:
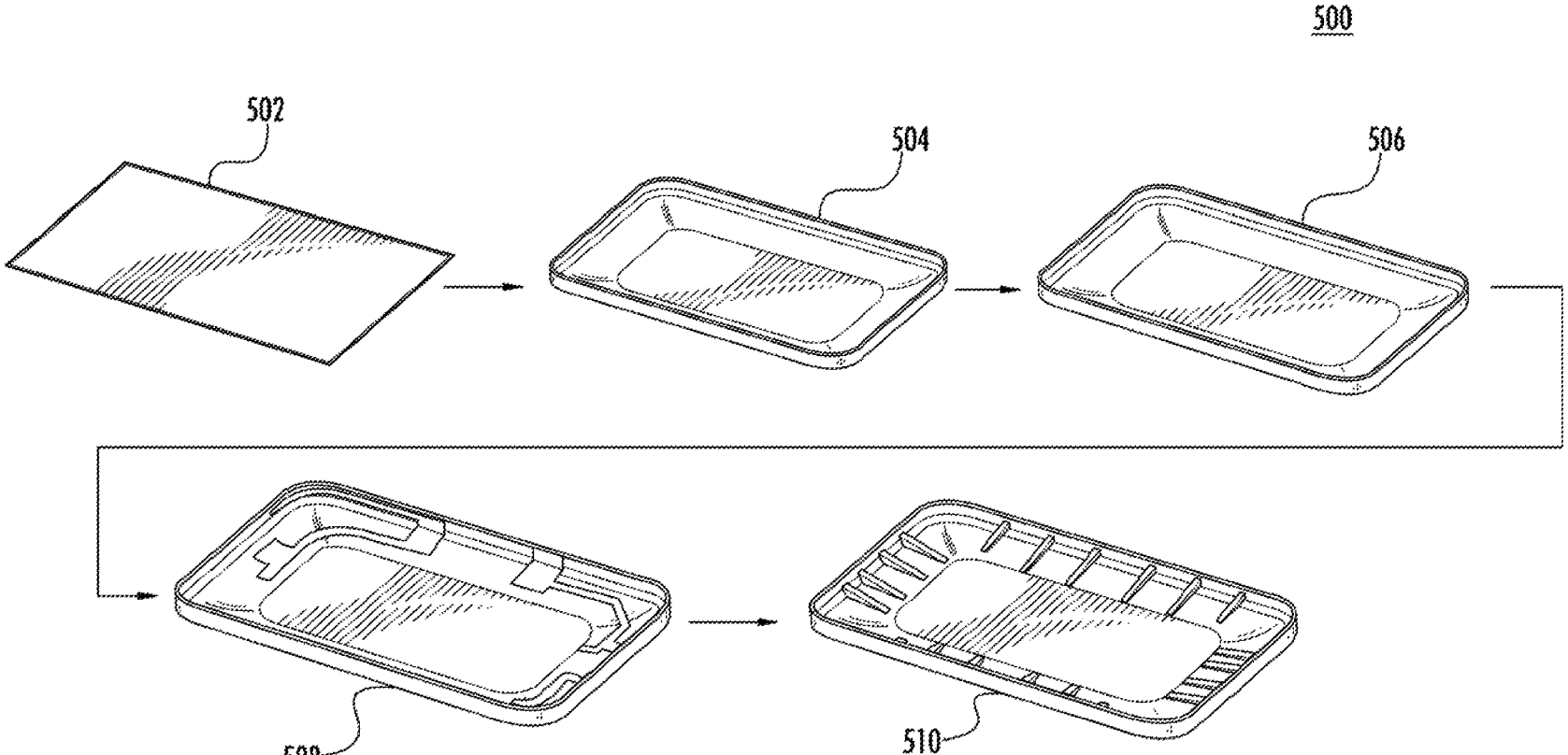
FIG. 5A is a first exemplary process flow diagram for incorporating a thin film antenna module into a mobile device housing, in accordance with the principles of the present disclosure.
Figure 5B:
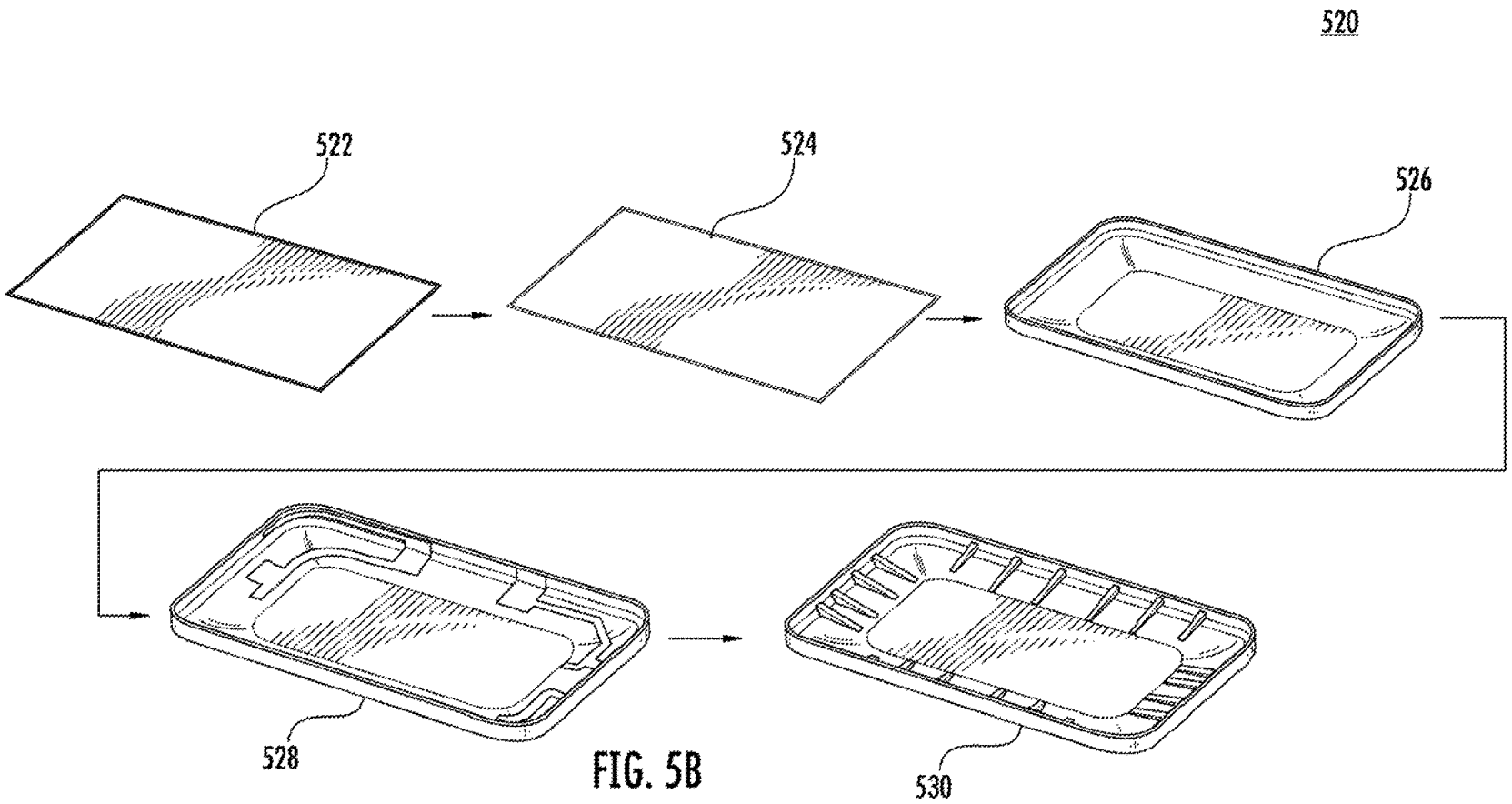
FIG. 5B is a second exemplary process flow diagram for incorporating a thin film antenna module into a mobile device housing, in accordance with the principles of the present disclosure.
Figure 5C:
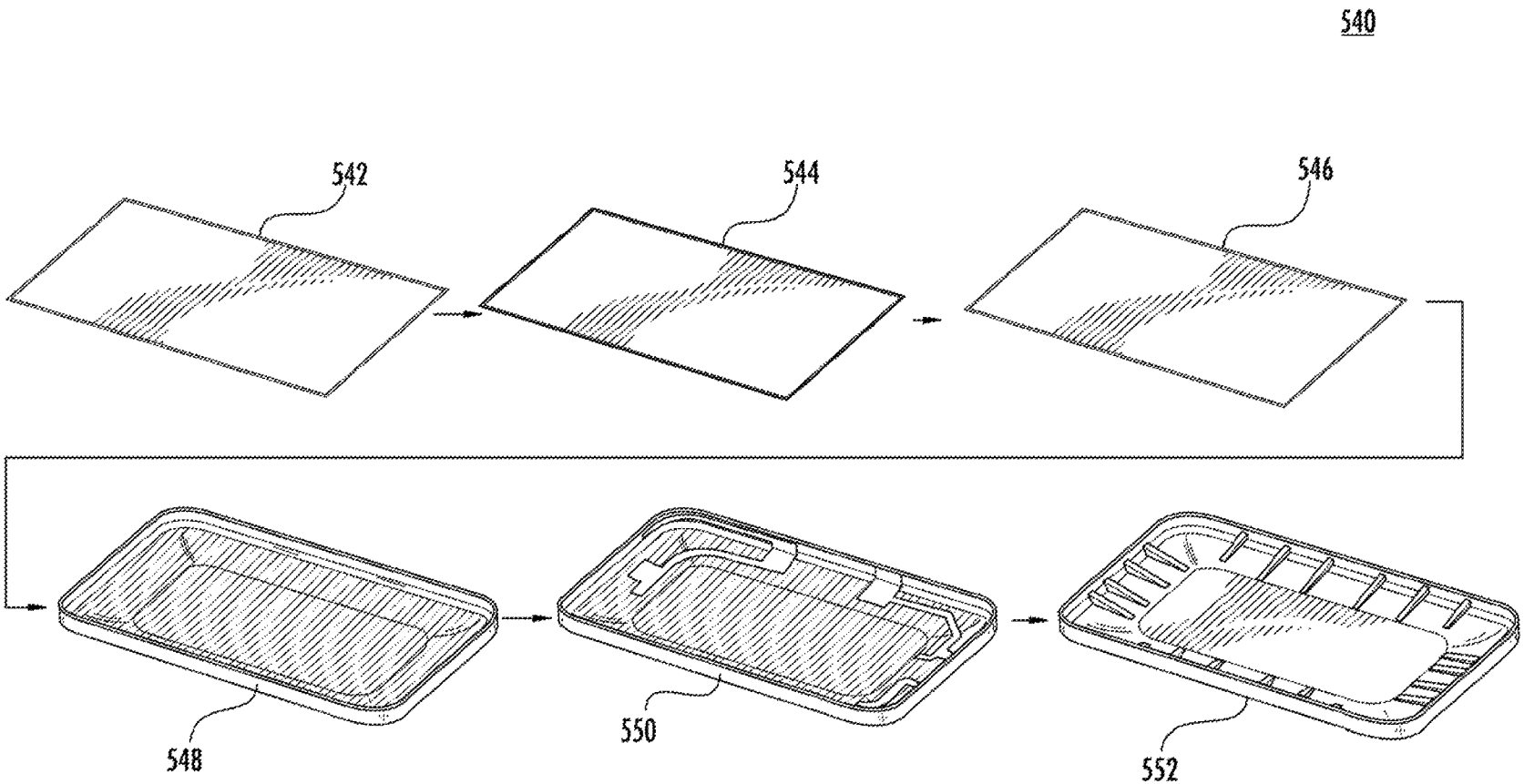
FIG. 5C is a third exemplary process flow diagram for incorporating a thin film antenna module into a mobile device housing, in accordance with the principles of the present disclosure.

Referring now to FIGS. 5A-5C, exemplary process flows using, for example, the radio antenna apparatus 100 of FIGS. 1A-1C or the radio antenna assembly 200 of FIG. 2 is shown and described in detail. Specifically, FIGS. 5A-5C illustrate the incorporation of the plastic film structure radio antenna apparatus onto the outer housing (i.e., on the inner and/or outer surface) of a mobile device. Such a methodology is low in both device and tooling costs, offers fast turnaround times and fast sampling, can be made decorative (e.g., freedom to be utilized in a variety of shapes as well as giving the device an appropriate finished "touch and feel") as well as being ultra-thin in construction. Furthermore, such a methodology does not require special materials for the underlying device chassis (as opposed to the use of LDS polymers as discussed supra).

Referring now to FIG. 5A, a first exemplary methodology 500 of utilizing, for example, the aforementioned radio antenna apparatus 100 of FIGS. 1A-1C or the radio antenna assembly 200 of FIG. 2 is shown. At step 502, a thin film plastic structure is obtained and can be manufactured from any number of thin film polymer materials including PEEK (polyether ether ketone), PET (polyethylene terephthalate), PEN (polyethylene naphthalate), PC (polycarbonate), ABS (acrylnitrile butadiene styrene) and PI (polyimide). At step 504, the thin film plastic structure is formed into a 3D shape using conventional thermoforming and/or vacuum forming processes. At step 506, the outer surfaces of the preformed thin film plastic structure are painted so as to hide the conductive pattern (step 508) from the end consumer. At step 508, a conductive pattern is added to the inner surface of the formed thin film plastic structure using, for example, a conductive fluid. For instance, in an exemplary embodiment, the methods and apparatus of U.S. patent application Ser. No. 13/782,993 filed Mar. 1, 2013 and entitled "DEPOSITION ANTENNA APPARATUS AND METHODS" are used for the deposition process, although others may be readily used with success. At step 510, the preformed thin film plastic structure is coupled with a mobile device housing. In one embodiment, the thin film plastic structure is attached to the top surface of the mobile device housing and secured thereto using glue or an adhesive. Alternatively, the thin film plastic structure can be insert-molded into the mobile device housing. For example, in embodiments which utilize insert-molding, the use of PC is exemplary as the melting point of the PC thin film structure is the same as the PC material typically used for the device housing. Accordingly, there is good adherence to similar or the same PC materials between the thin film structure and the device housing. Other common polymer materials used in the manufacture of mobile device housings can also be selected so as to enable good adherence during insert-molding processes.

Referring now to FIG. 5B, an alternative methodology 520 of utilizing, for example, the aforementioned radio antenna apparatus 100 of FIGS. 1A-1C or the radio antenna assembly 200 of FIG. 2 is shown. At step 522, a thin film plastic structure is obtained and can be manufactured from any number of thin film polymer materials including PEEK (polyether ether ketone), PET (polyethylene terephthalate), PEN (polyethylene naphthalate), PC (polycarbonate), ABS (acrylnitrile butadiene styrene), and PI (polyimide). At step 524, the outer surfaces of the thin film plastic structure are painted. At step 526, the thin film plastic structure is formed into a 3D shape using conventional thermoforming and/or vacuum forming processes. At step 528, a conductive pattern is added to the inner surface of the formed thin film plastic structure using a conductive fluid. For instance, in the exemplary embodiment, the methods and apparatus of U.S. patent application Ser. No. 13/782,993 filed Mar. 1, 2013 and entitled "DEPOSITION ANTENNA APPARATUS AND METHODS" are used for the deposition process, although others may be used with equal success. At step 530, the preformed thin film plastic structure is coupled with a mobile device housing. In one embodiment, the thin film plastic structure is attached to the top surface of the mobile device housing and secured thereto using an adhesive. Alternatively, the thin film plastic structure can be insert-molded into/onto the mobile device housing when, for example, the mobile device housing is formed.

Referring now to FIG. 5C, yet another alternative methodology 540 of utilizing, for example, the aforementioned radio antenna apparatus 100 of FIGS. 1A-1C or the radio antenna assembly 200 of FIG. 2 is shown. At step 542, a thin film plastic structure is obtained and can be manufactured from any number of thin film polymer materials including PEEK (polyether ether ketone), PET (polyethylene terephthalate), PEN (polyethylene naphthalate), PC (polycarbonate), ABS (acrylnitrile butadiene styrene), and PI (polyimide). At step 544, the thin film plastic structure is textured (e.g., knurled) to obtain the desired finish (e.g., to the give the finished product the proper "touch and feel") for the outer surface of the finished mobile device. At step 546, the outer surfaces of the thin film plastic structure are painted. At step 548, the thin film plastic structure is formed into a 3D shape using conventional thermoforming and/or vacuum forming processes. At step 550, a conductive pattern is added to the inner surface of the formed thin film plastic structure using a conductive fluid. For instance, in the exemplary embodiment, the methods and apparatus of U.S. patent application Ser. No. 13/782,993 filed Mar. 1, 2013 and entitled "DEPOSITION ANTENNA APPARATUS AND METHODS" are used for the deposition process, although others may be used with equal success. At step 552, the preformed thin film plastic structure is coupled with a mobile device housing. In one embodiment, the thin film plastic structure is attached to the top surface of the mobile device housing and secured thereto using an adhesive. Alternatively, the thin film plastic structure can be insert-molded into/onto the mobile device housing.

It will be recognized that while certain aspects of the present disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure disclosed and claimed herein.

While the above detailed description has shown, described, and pointed out novel features of the audio module as applied to various embodiments, it will be understood that various omissions, substitutions, and changes in the form and details of the device or process illustrated may be made by those skilled in the art without departing from the fundamental principles of the audio module. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. An antenna assembly for use in a mobile device, comprising:

a thin flexible antenna structure comprising a radiator and a plurality of contacts, wherein the radiator and the plurality of contacts are deposited onto the thin flexible antenna structure using a flowable conductive fluid; and a housing portion for the mobile device;

wherein:

the thin flexible antenna structure and the housing portion are bonded to one another, and the thin flexible antenna structure comprises a textured surface;

the thin flexible structure comprises a three-dimensional shape configured to couple to an external surface of the housing portion of the mobile device; and the radiator and the plurality of contacts are disposed on an inner surface of the thin flexible structure and also disposed on the external surface of the housing portion of the mobile device.

2. The antenna assembly of claim 1, wherein the thin flexible antenna structure is bonded to the housing portion via an adhesive.

3. The antenna assembly of claim 1, wherein the thin flexible antenna structure is insert-molded with the housing portion.

4. The antenna assembly of claim 1, wherein the thin flexible structure permits the antenna assembly to conform to one or more three-dimensional features present on the housing portion of the mobile device.

5. The antenna assembly of claim 4, wherein the conformance of the antenna assembly to the three-dimensional features comprises at least one angular bend in the thin flexible antenna structure corresponding to at least one internal feature of the housing portion of the mobile device.

6. The antenna assembly of claim 4, wherein the thin flexible antenna structure comprises a translucent structure that is painted.

7. The antenna assembly of claim 4, wherein the thin flexible antenna structure further comprises a second radiator disposed thereon; and wherein the radiator disposed on the inner surface of the thin flexible substrate and the second radiator disposed on an outer surface of the thin flexible structure are connected through via holes.

8. The antenna assembly of claim 7, wherein the thin flexible antenna structure is bonded to the housing portion via an adhesive.

9. The antenna assembly of claim 7, wherein the thin flexible antenna structure is insert-molded with the housing portion.

10. A method of manufacturing an antenna assembly for use with a mobile device, the method comprising:

obtaining a thin flexible polymer structure;

texturing the thin flexible polymer structure;

forming the thin flexible polymer structure into a three-dimensional form, the three-dimensional shape being configured to couple to an external surface of a housing of the mobile device;

disposing a first antenna radiator and a plurality of contacts on an inner surface of the textured thin flexible polymer structure using a deposition process so as to form an antenna for use with at least one wireless interface of the mobile device; and bonding the antenna with a housing portion associated with the mobile device such that the first antenna radiator and the plurality of contacts are also disposed on the external surface of the housing.

11. The method of claim 10, further comprising:

forming the thin flexible polymer structure into the three dimensional form prior to the disposing of the first antenna radiator.

12. The method of claim 11, further comprising:

painting the thin flexible polymer structure prior to the disposing of the first antenna radiator.

13. The method of claim 12, further comprising painting the thin flexible polymer prior to the forming of the thin flexible polymer structure into the three dimensional form.

14. The method of claim 11, further comprising texturing the thin flexible polymer structure prior to the forming of the thin flexible polymer structure into the three dimensional form.

15. A wireless mobile device, comprising:

a housing;

at least one wireless transceiver; and an antenna assembly in signal communication with the at least one wireless transceiver, the antenna assembly comprising:

a thin flexible structure comprising a textured surface, the thin flexible structure having an antenna comprising an antenna radiator and a plurality of contacts, the antenna radiator and the plurality of contacts being deposited onto the thin flexible structure using a flowable conductive fluid;

wherein:

the thin flexible structure is bonded to the housing;

the thin flexible structure comprises a three-dimensional shape configured to couple to an external surface of the housing; and the antenna radiator and the plurality of contacts are disposed on an inner surface of the thin flexible structure and also disposed on the external surface of the housing.

16. The wireless mobile device of claim 15, wherein the thin flexible structure permits the antenna assembly to conform to one or more three-dimensional features present on the housing of the wireless mobile device.

17. The wireless mobile device of claim 16, wherein one or more of the plurality of contacts comprise conductive via holes configured to permit electrical connection to another thin flexible structure.

18. The wireless mobile device of claim 17, wherein the thin flexible structure is bonded to the housing via an adhesive.

19. The wireless mobile device of claim 17, wherein the thin flexible structure is insert-molded with at least a portion of the housing.

20. The wireless mobile device of claim 15, wherein another radiator pattern is disposed on an outer surface of the thin flexible structure, and the plurality of contacts comprise conductive via holes configured to connect the radiator and the other radiator pattern.

* * * * *